US006572727B1

(12) United States Patent
Schulte

(10) Patent No.: US 6,572,727 B1
(45) Date of Patent: Jun. 3, 2003

(54) METHOD FOR PRODUCING ADHESIVE CLOSING PARTS

(75) Inventor: Axel Schulte, Holzgerlingen (DE)

(73) Assignee: Gottlieb Binder GmbH & Co., Holzgerlingen (DE)

( * ) Notice: Subject to any disclaimer, the term of this patent is extended or adjusted under 35 U.S.C. 154(b) by 0 days.

(21) Appl. No.: 09/582,713

(22) PCT Filed: May 22, 1998

(86) PCT No.: PCT/EP98/03055

§ 371 (c)(1),
(2), (4) Date: Jun. 30, 2000

(87) PCT Pub. No.: WO99/60880

PCT Pub. Date: Dec. 2, 1999

(51) Int. Cl.[7] ..... B32B 31/12

(52) U.S. Cl. ..... 156/278; 264/134; 264/135; 264/46.4; 427/155; 428/100; 24/444

(58) Field of Search ..... 264/130, 135, 264/46.4, 134; 427/155; 156/278; 428/100; 24/444

(56) References Cited

U.S. PATENT DOCUMENTS 5,286,431 A * 2/1994 Banfield et al. ..... 264/46.4
6,261,164 B1 * 7/2001 Rivard et al. ..... 451/359

FOREIGN PATENT DOCUMENTS

| | | |
|---|---|---|
| EP | 0 418 951 A2 | 3/1991 |
| EP | 0 612 485 A1 | 8/1994 |
| EP | 0 809 952 A2 | 12/1997 |
| EP | 0 829 563 A2 | 3/1998 |
| WO | 92/19119 | 11/1992 |

* cited by examiner

*Primary Examiner*—Michael W. Ball
*Assistant Examiner*—Jessica Rossi
(74) *Attorney, Agent, or Firm*—Roylance, Abrams, Berdo & Goodman, L.L.P.

(57) ABSTRACT

A method produces adhesive closing parts having adhesive closing elements made of plastic materials. The elements interact with corresponding adhesive closing elements of a second adhesive closing part to form an adhesive closure. The adhesive closing part having the adhesive closing elements is applied, at least in part, with a coating. The thickness of the coating is chosen such that it ensures subsequent formation of an adhesive closure. Adhesive closures with enhanced application possibilities can thus be produced.

12 Claims, 1 Drawing Sheet

METHOD FOR PRODUCING ADHESIVE CLOSING PARTS

FIELD OF THE INVENTION

The present invention relates to a method for producing adhesive closing parts made of plastic and having adhesive closing elements which cooperate with corresponding adhesive closing elements of another adhesive closing part for the formation of an adhesive closing. The adhesive closing part with the adhesive closing elements is provided with at least a partial coating. The layer thickness of the partial coating is determined so that the subsequent formation of the adhesive closing is guaranteed.

BACKGROUND OF THE INVENTION

A method for producing adhesive closing parts of plastic material is described in DE 196 46 318 A1. With that known production method, the adhesive closing part has a plurality of adhesive closing elements, each configured of one integral piece in the form of a stalk having a thickening or enlarged area. A thermoplastic, especially polyolefin or polyamide, is fed in plastic or liquid state into a gap between a platen and a grooved roll. The grooved roll is provided with outwardly and inwardly open hollow spaces. The two rolls are driven in rotation counter to one another. The grooved roll includes a screen with the hollow spaces produced by etching or by means of a laser. The adhesive closing elements do not come into being until the thermoplastic hardens in the open hollow spaces of the screen of the grooved roll. The thickenings or enlarged areas at the tops of the closing element stalks are configured in the form of mushroom heads having flattened out or concave depressions.

The adhesive closings produced in that manner are used most often in power vehicle technology, in soil working technology, for coverings of any sort and in some fields of special use in mechanical engineering. The adhesive closings have been proven in these areas as a detachable and operationally secure connection and closing technique.

EP-A-0418 951 introduces a method for producing adhesive closing elements for an adhesive closing in which the adhesive closing elements are provided with a coating of a pressure-sensitive adhesive. The adhesive coating is to heighten the adhesive and closing forces of the known adhesive closing.

Another method of this type is disclosed in EP-A-0829 563, in which the adhesive closing elements in the form of loops are provided with a coating with fluorocarbon. Such coating represents the base according to an impregnation method, in which the fluorocarbon penetrates into the plastic material of the adhesive closing elements. In that manner, the coating serves to repel the foam during foaming of the adhesive closing. The possibilities of use of such impregnated adhesive closing parts are limited.

SUMMARY OF THE INVENTION

Objects of the present invention are to provide an improved method for the production of adhesive closing parts of plastic material and having adhesive closing elements permitting adhesive closings with expanded ranges of possible uses.

According to the present invention, the coating for the adhesive closing elements is formed by a sol-gel method. A coating material is obtained which considerably broadens the possible uses for such adhesive closings. Thus, by means of the coating obtained by the sol-gel method, new and advantageous properties can be attributed to the closing.

The coating being applied by the sol-gel method is foam-resistant and works effectively counter to the possible penetration of the foam material during foaming, although the foam might have viscosities which are lower than that of water.

Furthermore, the coating applied by the sol-gel method can be constructed nano-compositionally. In other words, the layer thickness is extraordinarily minute. Thus, the coating medium can be of only a few molecules thickness. Because of this small layer thickness, the adhesive closing elements can indeed be completely covered, but are still not in any manner negatively influenced in their functionality. In other words, they can be connected with other adhesive closing elements, coated if desired, of another adhesive closing part for the formation of the adhesive closing.

Furthermore, the coating obtained by the sol-gel method can be provided with ferromagnetic properties. The very flat adhesive closing elements are preferably provided with plate-shaped ends that can be inserted manually without further difficulty into the foaming mold provided with magnets. The closing elements are then held securely by means of the magnetic forces of the coating medium, with the result that additional fixing devices can be abandoned or omitted.

Such additives, including those in the form of ferrites or magnetite materials, can be present in micro-encapsulated form, in other words as encapsulations of finely dispersed, liquid or solid phases formed by sheathing with film-forming polymers. The additives are deposited following emulsification and coacervation, or boundary layer or interfacial polymerization on the material to be sheathed.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
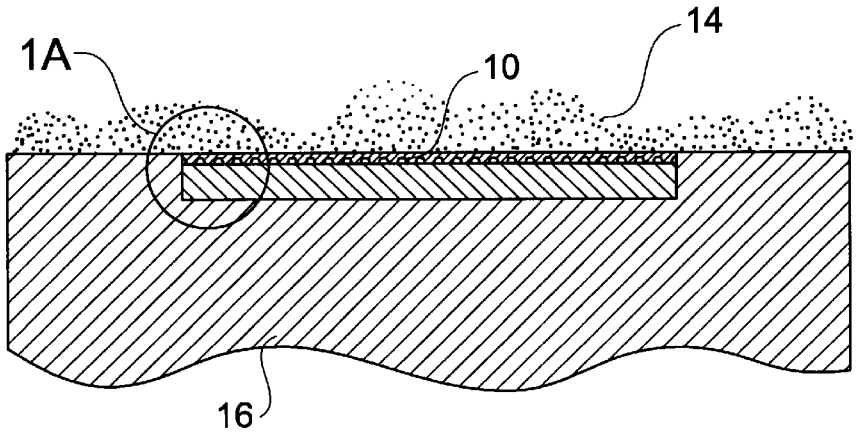
FIG. 1 is a side elevational view in section of an adhesive closing part in a foaming mold according to an embodiment of the present invention.
Figure 1A:
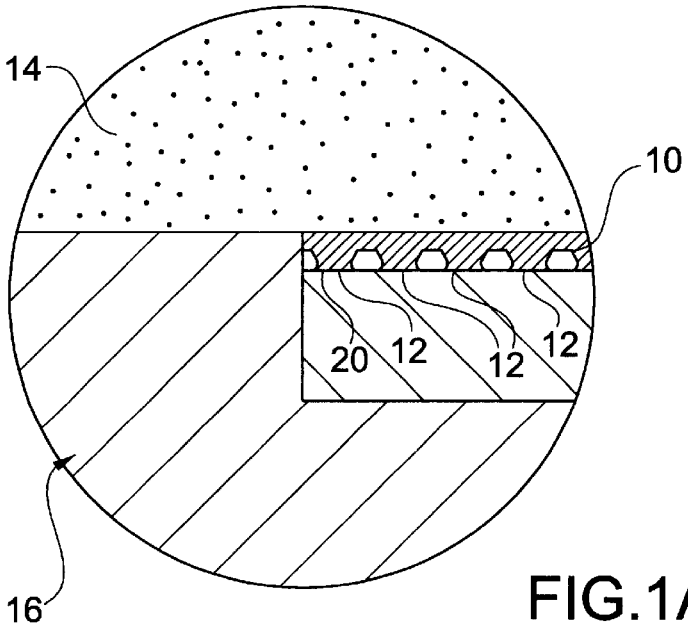
FIG. 1A is an enlarged, side elevational view in section of a part of the adhesive closing part and foaming mold of FIG. 1.
Figure 2:
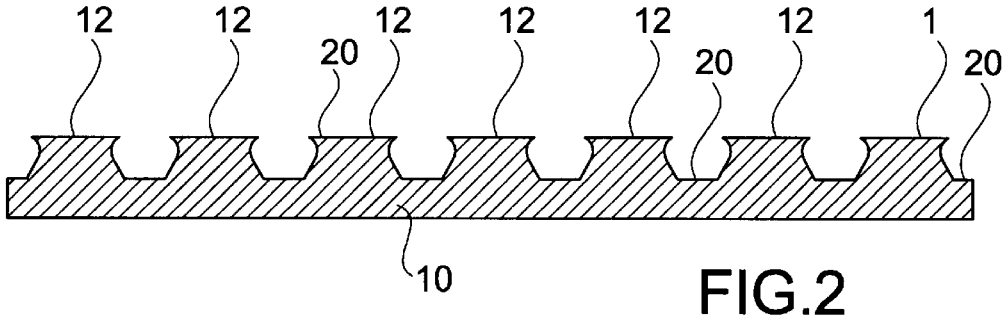
FIG. 2 is an enlarged side elevational view in section of the adhesive closing part of FIG. 1, provided with a coating.

The adhesive closing part 10 shown in FIG. 2 incorporates a plurality of adhesive closing elements 12 on its top strip side. The closing elements cooperate with correspondingly configured adhesive closing elements of another adhesive closing part, forming a traditional adhesive closing, not shown. Such adhesive closing parts 10 generally speaking are configured in strip-like arrangement or have flat geometric dimensions, and can, for example, be produced according to a method as is described in DE 196 46 318 A1.

Adhesive closing elements 12 produced in this manner can be produced in fragments of only millimeters width or breadth. They preferably have flat exposed ends for effective connection with other and correspondingly configured adhesive closing elements. On the side of adhesive closing part 10 opposite adhesive closing elements 12, conventional connecting loops (not shown) are provided for a holohedral connection with the foam material 14.

A foaming mold 16 is provided for execution of the foaming process. The mold frequently has two parts into which the foam material 14 is introduced after its closing under pressure and heat. As soon as foam material 14 is hardened into the form of the foam body, for example of polyurethane, the foam body is removed from the mold, with the adhesive closing elements 12 projecting outward on the exposed side of the foam body. The adhesive closing part 10 is connected tightly with the foam 14. In foaming mold 16, which conventionally includes steel and/or magnet inserts 18, the relevant required adhesive closing part 10 is inserted manually before the foaming process. The adhesive closing elements 12 face foaming mold 16 in the molding process.

In order that foam material 14 can enter, but not in a deleterious manner, into the intermediate spaces between adhesive closing elements 12, the adhesive closing elements are provided at least partially with a foam-resistant coating 20, the same as that side of adhesive closing part 10 which is contiguous with adhesive closing elements 12. Coating 20 is formed of a sol-gel, which can be adjusted to be oleophobic and/or hydrophobic. The functionality of adhesive closing elements 12 will not be negatively influenced by the coating, since the sol-gel is sprayed or scraped in a nano-compositional coating onto the foam-resistant side of adhesive closing part 10. Nano-compositional means that the layer thickness of the coating lies in the nanometer range. The consequence of having such a thin layer is that the subsequent connection with the associated adhesive closing elements of the other adhesive closing part is not negatively influenced.

An ammonia solution (500 ml, 0.7 mole) is added, preferably for the maintenance of the solution of an aqueous mixture of iron(II) chloride (40 ml, 1 mole) and iron(III) chloride (10 ml, 2 moles in hydrochloric acid 2 moles). The gelatin-like precipitate is isolated by centrifugation or decanting under magnetic influence, but is not washed out in water. Two possible means of processing this deposit result. To obtain an alkaline solution, especially an alkaline ferric fluid, the solution is produced by peptizing the deposit with one aqueous mole of tetramethylammonium hydroxide solution. In order to obtain an acidic solution, the deposit is stirred with an aqueous 2-mole perchloric acid, and subsequently, is isolated by centrifugation. The peptizing in this case is completed by addition of water.

Whether these are alkaline or acidic magnetic solutions, iron concentrations greater than one molar portion can be obtained. It is surprising that a solution is obtained only when the ratio of iron (III) to iron (II) is greater than 2, as in $Fe_3O_4$. When beginning with a mixture ratio of 2:1 and working under nitrogen, precipitates are obtained which cannot be peptized. With a greater beginning ratio or through oxidation under air, a stable solution can be produced.

Sol is the term used for a colloidal solution in which a solid or liquid material is dispersed in micro-dissemination in a solid, liquid or gaseous medium. Aerosols are to be considered for gaseous dispersion media, or vitreosols for solid media, or lyosols for liquid media. Lyosols are subdivided in turn into organosols and hydrosols, according to whether it involves suspension in organic or in aqueous phase. By coagulation (flocculation, flocculation by coagulation), a sol is converted into a gel, whereby gel is the derivative term used for gelatins for dispersed systems. Such gels are dimensionally stable, easily deformable and known from colloid chemistry, abundant in liquids and gases, and made up of at least two components the two components comprise at least one solid, colloidal split material with long or multiply branched particles and a liquid, generally water, as dispersion medium.

The $Fe_xO_y$ nano-solution of this type is mixed with a commercial $SiO_2$-$TiO_2$-modified sol and applied by means of spraying onto adhesive closing part 10 with its adhesive closing elements 12 and is affixed there by drying. The layer thickness is therefore sufficiently minimal that the operation of the individual adhesive closing elements is not influenced in prejudicial manner during the closing process. The aforementioned peptizing thus relates the conversion of a coagulate into a dispersed (colloidal) system.

Insofar as a ferromagnet is added to the system for the ferromagnetic properties (the ferromagnet being for example ferrite), this addition occurs for example by means of micro-encapsulation by intercalation in the sol in a stable and simultaneously flexible layer. The maximum thickness of such microcapsules is less than 0.2 mm. Micro-encapsulation is the term used for the encapsulation of finely dispersed liquid or solid phases by sheathing with film-forming polymers. Such polymers are deposited following emulsification and coacervation or boundary layer or interfacial polymerization on the material being ensheathed. Such microscopically small capsules, sometimes referred to in terms of nano-encapsulation, can be dried in the traditional manner. It is novel to an expert in the area of adhesive closing technology that such micro-encapsulated ferrites come to be settled only slightly or not at all on the exposed ends of adhesive closing elements 12, but rather in the area of their stalks or on the adjacent surface areas of adhesive closing part 10. Thus, an enhancement of the concentration in the area of the adhesive closing part is generated.

The resulting magnetic forces in connection with the relevant insert part 18 suffice to attain a secure connection of adhesive closing 10 in foaming mold 16. According to the desired thickness of the coating, either a scraping-on method or spraying method is suitable for application of a sol-gel coating for production of the desired nano-compositional coating. The ferromagnetic portion in the coating substance is in a weight percentage of between 5 and 70%, preferably however at 30%. Instead of the aforementioned micro-encapsulation however, for the balance of a ferromagnetic content in the sol-gel, magnetite can also be deposited therein. An improved foam-preventing effect can still be produced when a hydrophobizing or waterproofing medium is added to coating medium 20, whereby the viscosity of the coating medium can be adjusted by means of ethanol.

As one exemplary embodiment for a ferromagnetic coating, for instance, the following formula can be used:

1.5 kg sol MH (sol-gel experimental product of Firma Feinchemie GmbH, Sebnitz)

0.5 kg ferrite (grain size 10 microns)

0.05 kg Dynasylan F8261 (hydrophobizing or waterproofing medium of Firma ABCR, Karlsruhe)

The viscosity of the solution, as already stated, is adjusted with ethanol according to the coating method being used. With sufficiently low viscosity, the coating substance is determined to have a more highly concentrated enrichment in terms of ferrite in the base formula of the coating.

Coating 20 can be coated on by padding, immersion, spraying, moistening, vapor deposition, laminating or scraping-on, as well as laminating on adhesive closing part 10. Dependent upon the coating method being used, coating 20, as shown in FIG. 2, can if necessary completely sheath the individual adhesive closing element 12 even with different wall thicknesses. The resulting coating, for example, by laminating or scraping on as well as laminating by coagulation can also however comprise coating only the exposed ends of adhesive closing elements 12, but not however their stalks or that side of adhesive closing part 10 which is contiguous with adhesive closing elements 12. The relevant layer can also be present in the form of hardened droplets or can form segmented layer portions in segments separated from one another. Insofar as coating 20 is modified with ferrite or magnetite or other special additives, by means of the force of its weight, it can enhance the concentration of the additive on the bottom of adhesive closing part 10.

Insofar as a spray adhesive is being used as coating medium 20, this spray adhesive preferably includes 10% magnetite, 10% solvent-containing polyurethane (Fa. Stahl Su9182) as well as 80% ethanol.

For a so-called transfer coating using a carrier material, for example in the form of foil or paper, provided with 40% magnetite and 60% solvent-containing polyurethane, the carrier material is applied in such a manner on the top side of adhesive closing elements 12. Following drying then the laminating material (foil or paper) is removed from adhesive closing part 10 and the transfer medium or laminate is left permanently as a component part of the coating of the adhesive closing part 10.

While a particular embodiment has been chosen to illustrate the invention, it will be understood by those skilled in the art that various changes and modifications can be made therein without departing from the scope of the invention as defined in the appended claims.

What is claimed is:

1. A method for producing adhesive closing parts, comprising the steps of:

forming from plastic a first adhesive closing part with adhesive closing elements which can cooperate with corresponding adhesive closing elements of a second adhesive closing part to form an adhesive closing;

forming a coating material by a sol-gel method; and at least partially coating the first adhesive closing part with the coating material formed by the sol-gel method, the coating having a layer thickness that does not fill gaps between the adhesive closing elements and does not substantially change the shape of the adhesive closing elements thereon.

2. A method according to claim 1 wherein the coating is foam-resistant.

3. A method according to claim 1 wherein the coating is a nano-compositional coating.

4. A method according to claim 1 wherein the sol-gel method uses a sol-gel selected from $SiO_2$— and/or $TiO_2$— modified $SiO_2$.

5. A method according to claim 1 wherein the coating material is provided with a hydrophobizing, water proofing and/or oleophobizing medium.

6. A method according to claim 1 wherein the coating is permanently applied to the first closing part.

7. A method according to claim 1 wherein the coating material is applied on the adhesive closing part by padding, immersion, spraying, moistening, vapor deposition, laminating or scraping with laminating.

8. A method according to claim 1 wherein the coating material is provided with dye additives, with ultraviolet radiation protection media, with properties for absorbing and/or reflecting microwaves, and/or with properties for absorbing and/or reflecting infrared radiation.

9. A method according to claim 1 wherein the coating material is provided with ferromagnetic properties.

10. A method according to claim 9 where magnetite balances a ferromagnetic content of the sol-gel.

11. A method according to claim 9 wherein the sol-gel method uses a sol-gel mixed with ferrite or a ferrite containing material of the formula $Fe_xO_y$.

12. A method according to claim 11 where magnetite balances a ferromagnetic content of the sol-gel.

* * * * *